US007196474B2

(12) United States Patent
Kim et al.

(10) Patent No.: US 7,196,474 B2
(45) Date of Patent: Mar. 27, 2007

(54) ELECTRODELESS LIGHTING APPARATUS

(75) Inventors: Hyun-Jung Kim, Seoul (KR); Ji-Young Lee, Gyeonggi-Do (KR); Seung-Yeup Hyun, Jeju-Do (KR); Ri-Na Hwang, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/269,835

(22) Filed: Nov. 9, 2005

(65) Prior Publication Data

US 2006/0202628 A1 Sep. 14, 2006

(30) Foreign Application Priority Data

Mar. 14, 2005 (KR) ..... 10-2005-0021136

(51) Int. Cl.
*H01J 65/04* (2006.01)

(52) U.S. Cl. ..... 315/39

(58) Field of Classification Search ..... 315/248, 315/39, 246, 312, 344
See application file for complete search history.

(56) References Cited

U.S. PATENT DOCUMENTS 6,046,545 A * 4/2000 Horiuchi et al. ..... 315/39
6,617,793 B2 * 9/2003 Choi et al. ..... 315/39
6,784,619 B2 * 8/2004 Choi ..... 315/39.51
6,954,037 B2 * 10/2005 Hu ..... 315/248
7,081,702 B2 * 7/2006 Seo ..... 313/153
7,129,639 B2 * 10/2006 Kim et al. ..... 315/39

* cited by examiner

*Primary Examiner*—Shih-Chao Chen
*Assistant Examiner*—Minh Dieua
(74) *Attorney, Agent, or Firm*—Birch, Stewart, Kolasch & Birch, LLP

(57) ABSTRACT

An electrodeless lighting apparatus includes: a waveguide for guiding microwave energy generated from a microwave generator; a resonance unit coupled with an outlet of the waveguide and comprising at least two resonators having mesh structures which are slidingly coupled with each other in the longitudinal direction such that the height of the resonance unit is varied and an aperture ratio according to the height of the resonance unit is varied, the resonance unit for resonating the microwave energy guided through the waveguide; and a bulb located inside the resonance unit and generating light as a material enclosed therein becomes plasma by microwave energy, so that the overall length of the resonance unit can be varied or aperture ratios of the mesh corresponding to the height of the resonance unit can be adjusted according to a bulb type and conditions to which the electrodeless lighting apparatus is applied, whereby a resonator does not need to be separately manufactured according to its length or aperture ratio. Accordingly, time and costs spent manufacturing a new resonator can be reduced to thereby lower the unit cost and maintenance costs can be reduced by decreasing the number of assembly processes when changing a bulb.

13 Claims, 9 Drawing Sheets

ELECTRODELESS LIGHTING APPARATUS

BACKGROUND OF THE INVENTION

1. Field of the Invention

The present invention relates to an electrodeless lighting apparatus and, more particularly, to an electrodeless lighting apparatus capable of varying its length and aperture ratios corresponding to its parts according to a change in surrounding conditions.

2. Description of the Background Art

In general, an electrodeless lighting apparatus is a device capable of effectively supplying light without an electrode as microwave generated from a microwave generator allows buffer gas inside a bulb to be in a plasma state and metal compound to continuously diffuse light. The electrodeless lighting apparatus has a longer life span and more excellent lighting effects than a general incandescent lamp or fluorescent lamp.

FIG. 1 is a longitudinal sectional view illustrating one example of a lighting apparatus using microwave energy in accordance with a conventional art.

A conventional lighting apparatus using a microwave energy, as shown in FIG. 1, includes a case 1 forming a predetermined internal space, a magnetron 2 mounted inside the case 1 and generating microwave, a high voltage generator 3 increasing general AC power to a high voltage and supplying it to the magnetron 2, a waveguide 4 for guiding microwave generated from the magnetron 2, a resonator 6 installed at an outlet 4*a* of the waveguide 4 in order to communicate with the waveguide 4, and having a mesh structure by which leakage of microwave is prevented but light is allowed to pass therethrough and a bulb 5 located inside the resonator 6 and generating light as an enclosed material becomes plasma by a microwave energy transmitted through the waveguide 4.

The lighting apparatus using microwave also includes a reflector 7 formed at a front side of the case 1, that is, at a neighboring region of the resonator 6, to concentratively reflect light generated from the bulb 5 forward.

A dielectric mirror 8 is installed in the outlet 4*a* of the waveguide 4 in order to allow microwave transmitted through the waveguide 4 to pass therethrough and light emitted from the bulb 5 to be reflected forward, and a hole 8*a* is formed at the center of the dielectric mirror 8 to allow a shaft portion 9 of the bulb 5 to penetrate therethrough.

A cooling fan assembly 10 for cooling the magnetron 2 and the high voltage generator 3 is provided at the rear of the case 1. Reference numeral 10*a* denotes a fan housing, 10*b* denotes a blowing fan, M1 denotes a bulb motor, and M2 denotes a fan motor.

The conventional lighting apparatus using microwave is operated as follows.

When a driving signal is inputted to the high voltage generator 3, the high voltage generator 3 increases AC power and supplies the increased high voltage to the magnetron 2. Then, oscillated by the high voltage, the magnetron 2 generates microwave having a very high frequency. The thusly generated microwave is guided through the waveguide 4 and radiated into the resonator 6 through a slot portion 4*b* formed at the inner side of the outlet 4*a* of the waveguide 4. The microwave radiated into the resonator 6 discharges a material enclosed in the bulb 5 to generate light having a specific spectrum, and as this light is reflected forward by the reflector 7 and the dielectric mirror 8, a lighting space becomes illuminated.

However, the conventional electrodeless lighting apparatus can maintain high light efficiency only when the length (or volume) of the resonator and an aperture ratio of mesh are changed if a distance between the outlet of the waveguide and the center of the bulb needs to be lengthened because of a change in the surrounding environment such as a change in color of the bulb or lateral lighting. In this case, since the resonator itself must be changed each time according to required conditions, a resonator whose length and aperture ratio vary according to the applied conditions is manufactured. Accordingly, manufacturing time and costs are excessively spent, and part of a system must be reassembled in order to change the resonator.

SUMMARY OF THE INVENTION

Therefore, it is an object of the present invention to provide an electrodeless lighting apparatus capable of varying its length and aperture ratio according to a change in the surrounding environment.

To achieve these and other advantages and in accordance with the purpose of the present invention, as embodied and broadly described herein, there is provided an electrodeless lighting apparatus including: a waveguide for guiding microwave energy generated from a microwave generator; a resonance unit coupled with an outlet of the waveguide and comprising at least two resonators having mesh structures which are slidingly coupled with each other in the longitudinal direction such that the height of the resonance unit is varied and an aperture ratio according to the height is varied, the resonance unit for resonating the microwave energy guided through the waveguide; and a bulb located inside the resonance unit and generating light as a material enclosed therein becomes plasma by microwave energy.

The foregoing and other objects, features, aspects and advantages of the electrodeless lighting apparatus of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
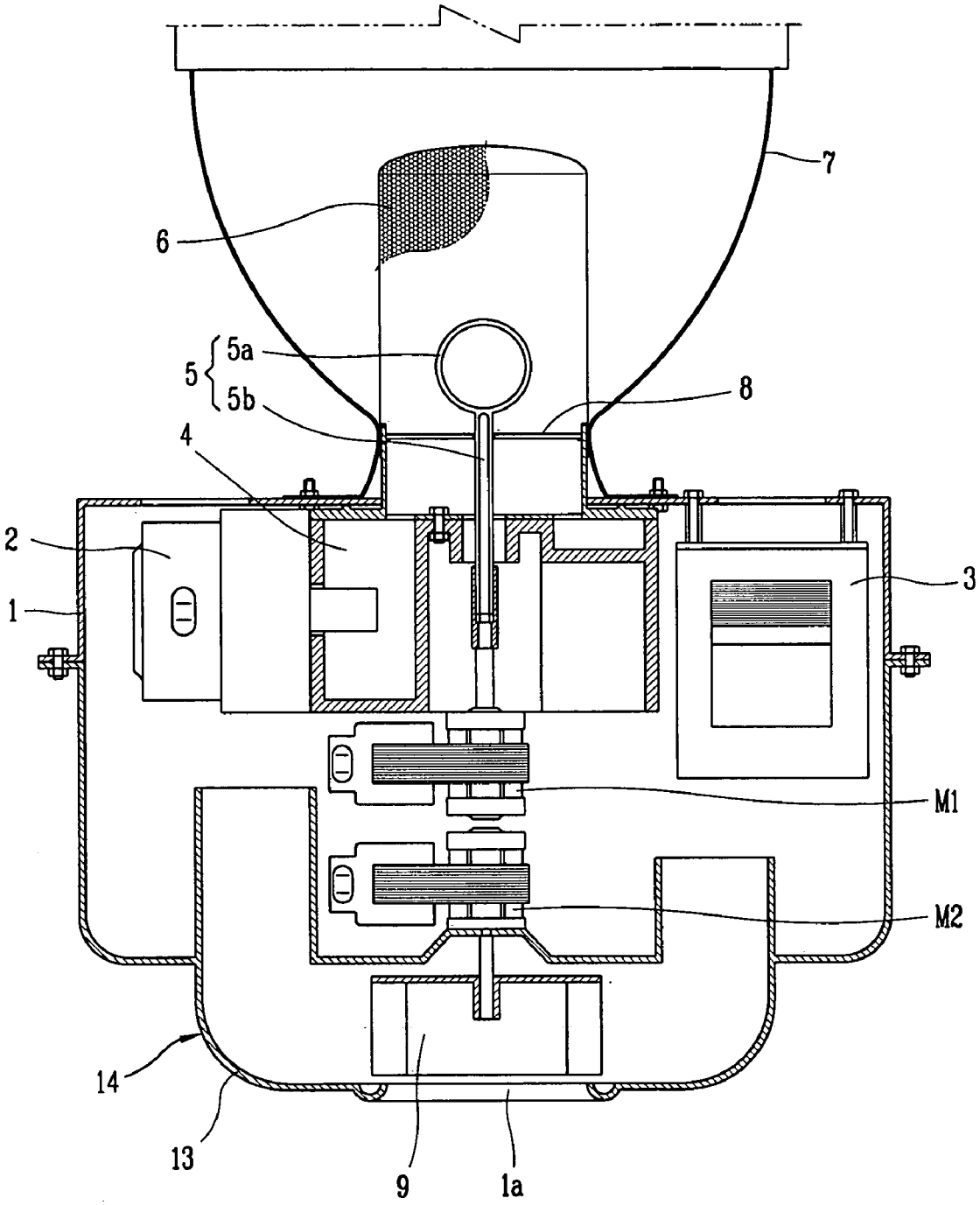
FIG. 1 CONVENTIONAL ART
FIG. 1 is a longitudinal sectional view showing an electrodeless lighting apparatus in accordance with a conventional art.
Figure 2:
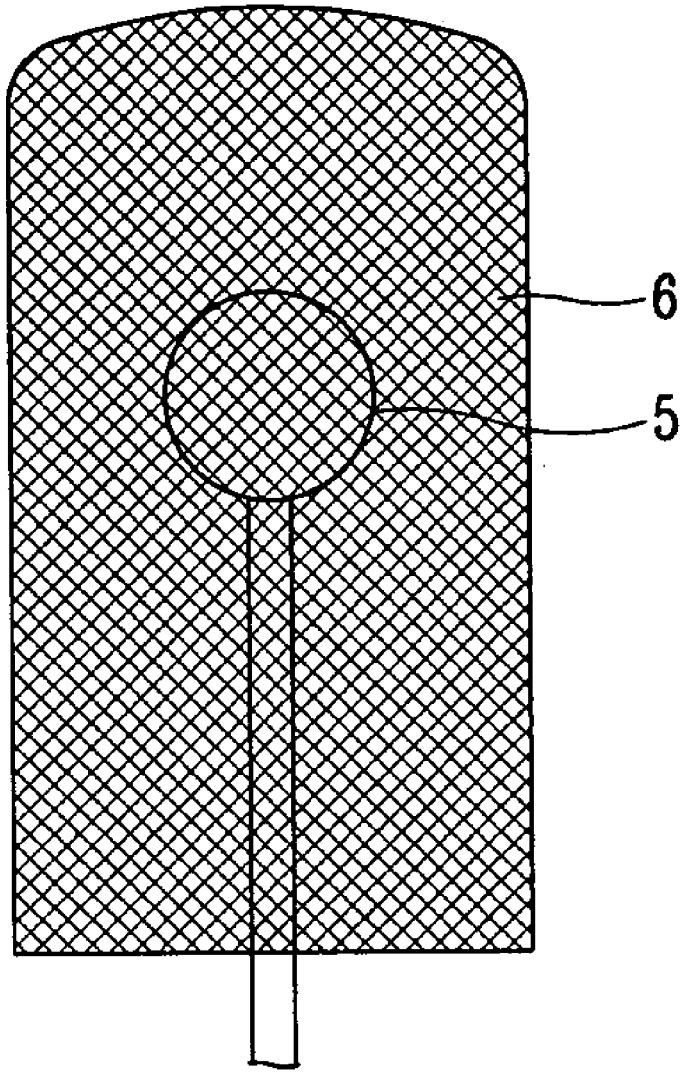
FIG. 2 CONVENTIONAL ART
FIG. 2 is a longitudinal sectional view of a resonator of the conventional electrodeless lighting apparatus.

Hereinafter, an electrodeless lighting apparatus in accordance with the present invention will be described in detail in accordance with one embodiment of the accompanying drawings.

There can be several embodiments of an electrodeless lighting apparatus in accordance with the present invention, of which the most preferred one will now be described. Here, the same reference numeral is given to the same construction as the conventional art.

Figure 3:
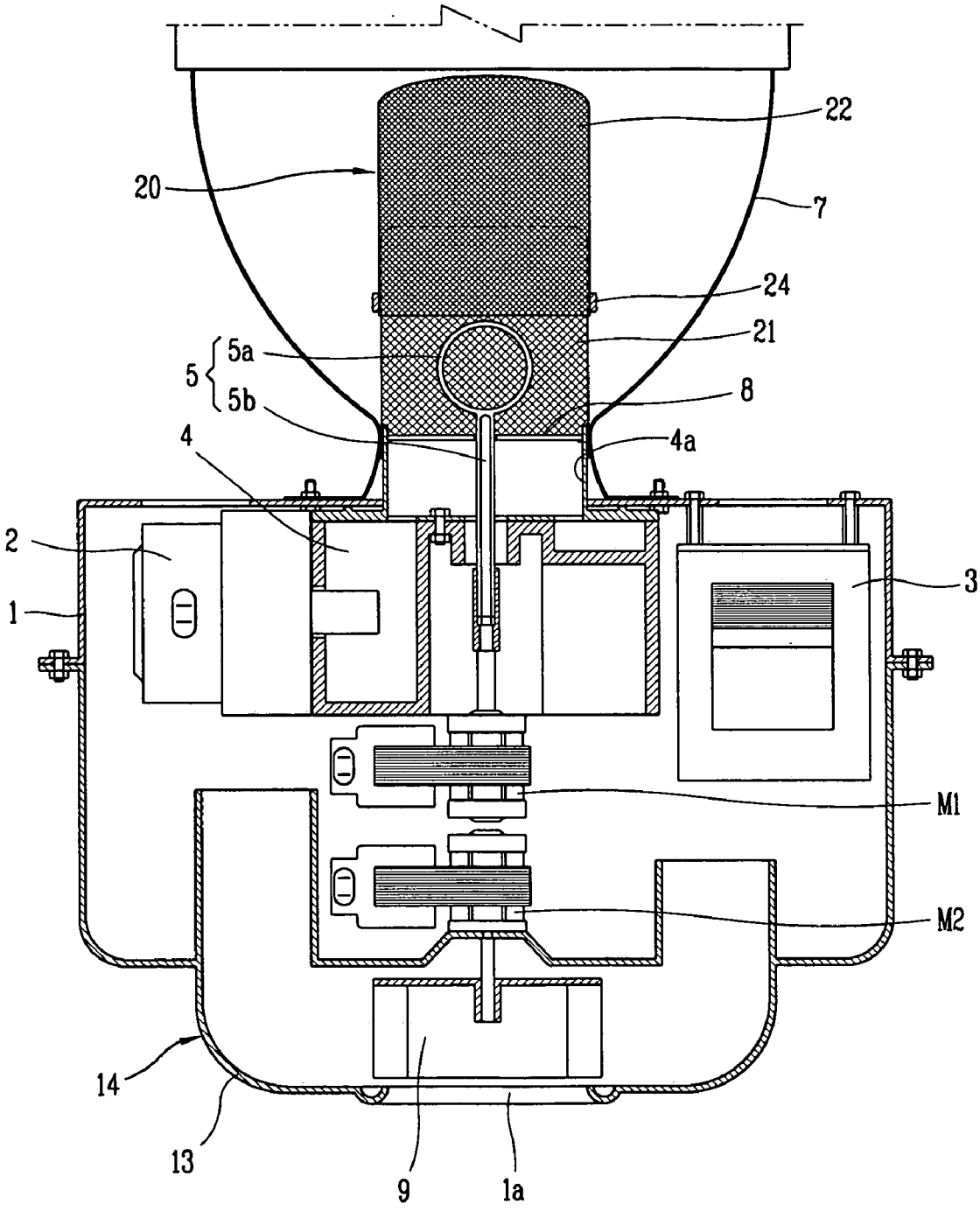
FIG. 3 is a longitudinal sectional view showing an electrodeless lighting apparatus in accordance with one embodiment of the present invention.
Figure 4:
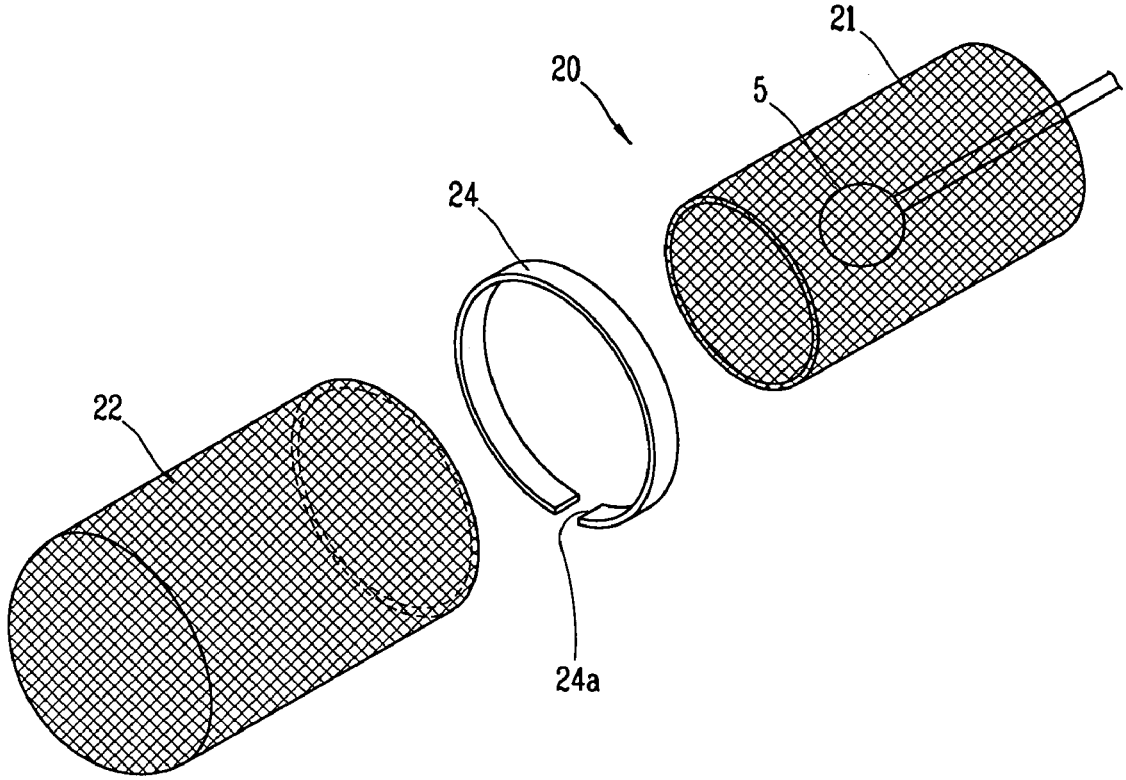
FIG. 4 is an exploded perspective view illustrating a resonance unit in accordance with the first embodiment of the present invention.
Figure 5:
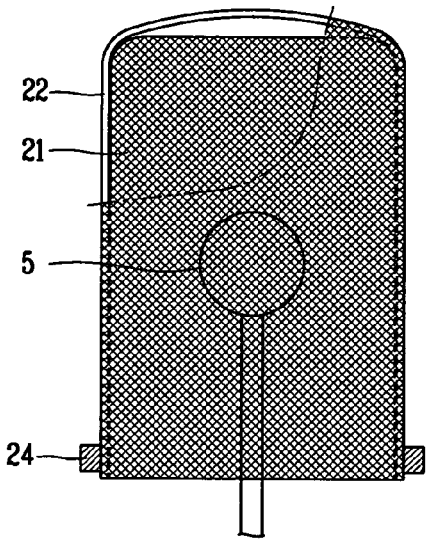
FIGS. 5 and 6 are longitudinal sectional views illustrating a coupling sate of the resonance unit in accordance with the first embodiment.
Figure 6:
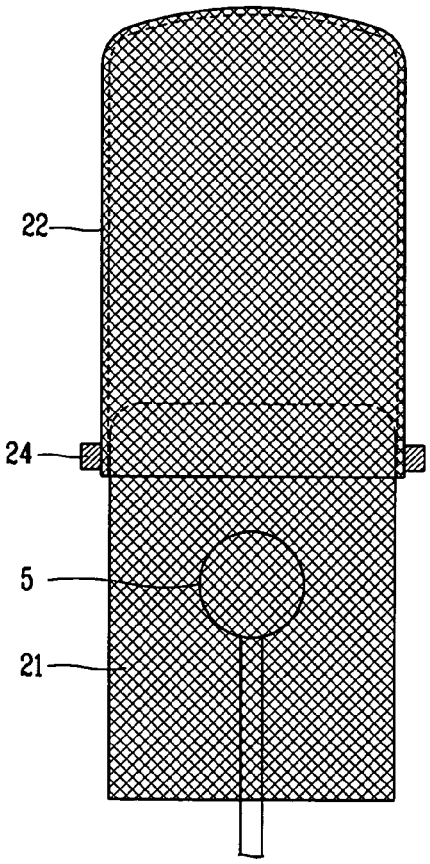

FIG. 3 is a longitudinal sectional view illustrating an electrodeless lighting apparatus in accordance with one embodiment of the present invention. FIG. 4 is an exploded perspective view illustrating a resonance unit of the first embodiment of the present invention. FIGS. 5 and 6 illustrate a coupling state of a resonance unit in accordance with the first embodiment of the present invention. As illustrated in FIG. 3, an electrodeless lighting apparatus in accordance with one embodiment of the present invention includes a microwave generator 2, like a magnetron, mounted inside a casing 1 and generating microwave, a high voltage generator 3 for increasing general AC power to a high voltage and supplying it to the microwave generator 2, a waveguide 4 communicating with an outlet of the microwave generator 2 and transmitting microwave generated from the microwave generator 2; a bulb 5 enclosing a radiation material, inactive gas and a light catalyst material therein and generating light as the enclosed radiation material becomes plasma by a microwave energy and a resonance unit 20 coupled with an outlet 4*a* of the waveguide 4 to position the bulb 5 therein and resonating microwave guided through the waveguide 4.

In addition, a reflector 7 for concentrating light, passing the resonance unit 20 from the bulb 5 and being diffused, toward the front is attached to the front of the casing 1, and a dielectric mirror 8 for allowing microwave to pass therethrough and reflecting light is installed inside the resonance unit 20 and at the rear of the bulb 5. In addition, a cooling fan 9 is provided at one side of the casing 1 in order to cool the microwave generator 2 and the high voltage generator 3. The bulb 5 includes a radiation unit 5*a* enclosing a radiation material and the like and emitting light and a support unit 5*b* integrally formed with and extending from the lamination unit 5*a*, rotatably supported inside the casing 1 and having its end coupled with a rotating shaft of a bulb motor (M1).

The resonance unit 20 is constructed such a manner that at least two resonators having mesh structures are slidingly coupled with each other in the longitudinal direction such that its overall height can be varied and an aperture ratio according to the height can be varied.

As illustrated in FIGS. 4 to 6, the resonance unit 20 of the first embodiment which is applied to the electrodeless lighting apparatus includes a first resonator coupled with the outlet 4*a* of the waveguide 4 and a second resonator 22 slidingly coupled with an outer circumferential surface of the first resonator 21 in the longitudinal direction.

The first resonator 21 having one end coupled with the outlet 4*a* of the waveguide 4 has the other end being opened which is opposite to said one end. Here, since the other end of the first resonator 21 which is coupled with the second resonator 22 is opened, the bulb 5 can be located at a higher position than the first resonator 21. According to the overall height of the resonance unit 20, the position of the bulb 5 can be freely changed.

Here, preferably, the first resonator 21 has a cylindrical structure, but it can have another shape such as a polygon according to conditions of a design.

In addition, the second resonator 22 also has the same shape as the first resonator 21 such that the second resonator 22 can be slidingly coupled with the first resonator 21. Preferably, the second resonator 22 also has the same cylindrical structure as the first resonator 21. In the second resonator 22, one end to be coupled with the first resonator 21 is opened and the other end (opposite end) has a mesh structure.

Here, the perimeter of an inner circumferential surface of the second resonator 22 is greater than that of an outer circumferential surface of the first resonator 21, so that the outer circumferential surface of the first resonator 21 is slidingly inserted into and coupled with the second resonator 22. At this time, preferably, an interval between the outer circumferential surface of the first resonator 21 and the inner circumferential surface of the second resonator 22 is formed to have almost no margin by which the second resonator 22 can move in a radial direction of the first resonator 21.

That is, the second resonator 22 is slidingly coupled with the first resonator 21 and therefore can move in the longitudinal direction of the first resonator 21. Accordingly, the overall length of the resonance unit 20 comprising the first resonator 21 and the second resonator 22 can be adjusted.

Here, the first resonator 21 and the second resonator 22 have the mesh structures having the same aperture ratio. At this time, the aperture ratio at a portion where the first resonator and the second resonator overlap each other is lower than the other portions.

Meanwhile, in order that the second resonator 22 is fixed to the first resonator 21, a first fixing member 24 is installed at the outer circumferential surface of the second resonator 22 overlapping the outer circumferential surface of the first resonator 21.

The first fixing member 24 has a ring shape in which an opening 24*a* is formed to encompass the outer circumferential surface of the second resonator 22 in order to press the outer circumferential surface of the second resonator 22 by an elastic restoring force. Here, the shape and structure of the first fixing member is not limited to this, and any structure by which the second resonator is fixed to the first resonator is possible.

Figure 7:
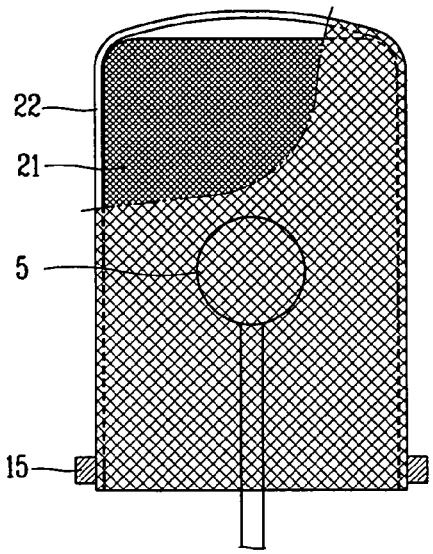
FIGS. 7 to 9 are longitudinal sectional views illustrating a coupling state of a resonance unit in accordance with the second embodiment of the present invention.
Figure 8:
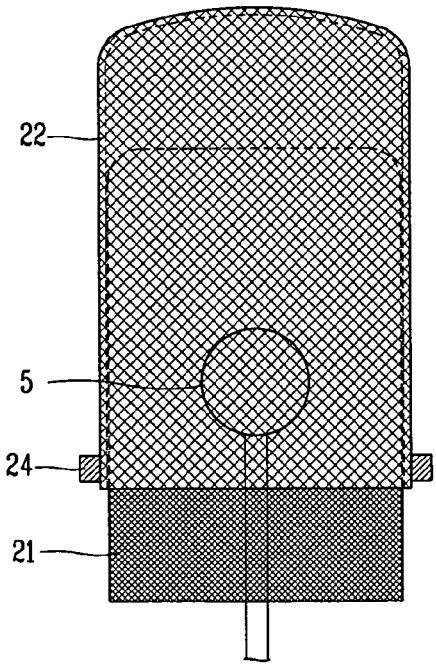
Figure 9:
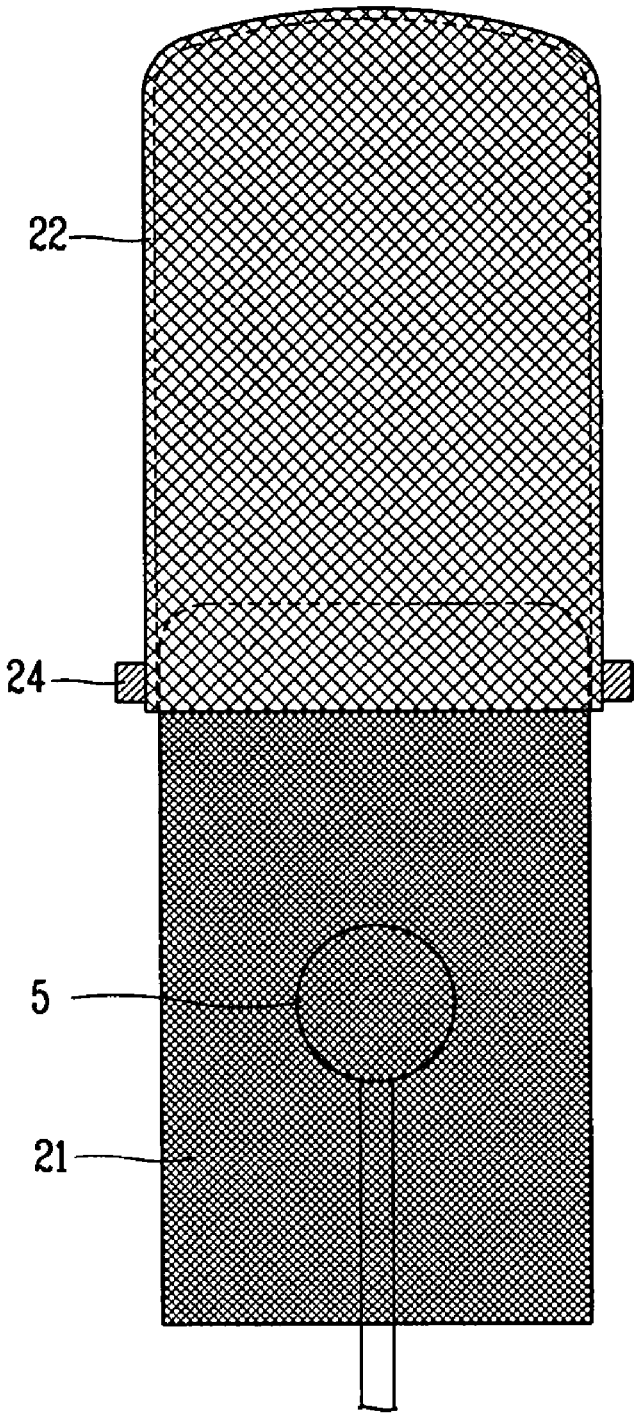

FIGS. 7 to 9 illustrate the second embodiment of the resonance unit applied to the electrodeless lighting apparatus of the present invention. As illustrated therein, the first resonator 21 and the second resonator 22 have different aperture ratios of mesh. Accordingly, when the position of the second resonator 22 is varied in the longitudinal direction with respect to the first resonator 21, three portions including a portion where the first resonator 21 and the second resonator 22 overlap each other are formed. Here, as illustrated in the drawings, the aperture ratio of the mesh of the first resonator 21 may be lower than that of the second resonator 22. Contrarily, the aperture ratio of the mesh of the first resonator 21 may be greater than that of the second resonator 22.

Here, the bulb 5 is preferably disposed at the portion having the lowest aperture ratio of the mesh among the portions having different aperture ratios of the mesh which are formed according to a position of the second resonator 22 which is varied with respect to the first resonator 21, whereby initial lighting is improved or brightness is increased.

Hereinafter, the third embodiment of the resonance unit applied to the electrodeless light apparatus of the present invention will be described. Here, the same construction as the resonance units in accordance with the first and second embodiments is given the same reference numerals.

Figure 10:
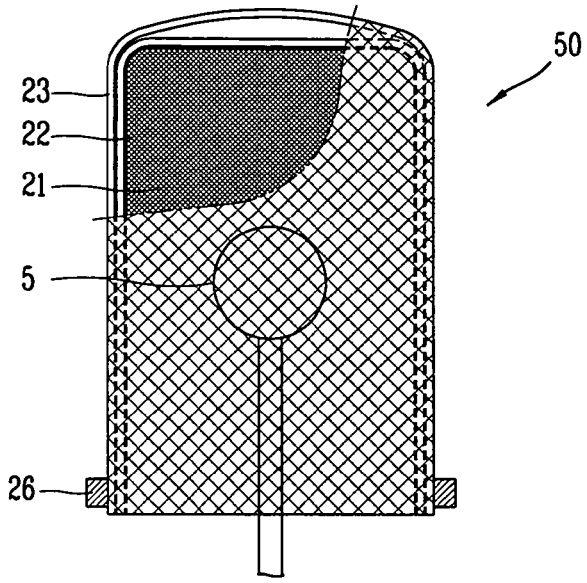
FIGS. 10 to 12 are longitudinal sectional views illustrating a coupling state of a resonance unit in accordance with the third embodiment of the present invention.
Figure 11:
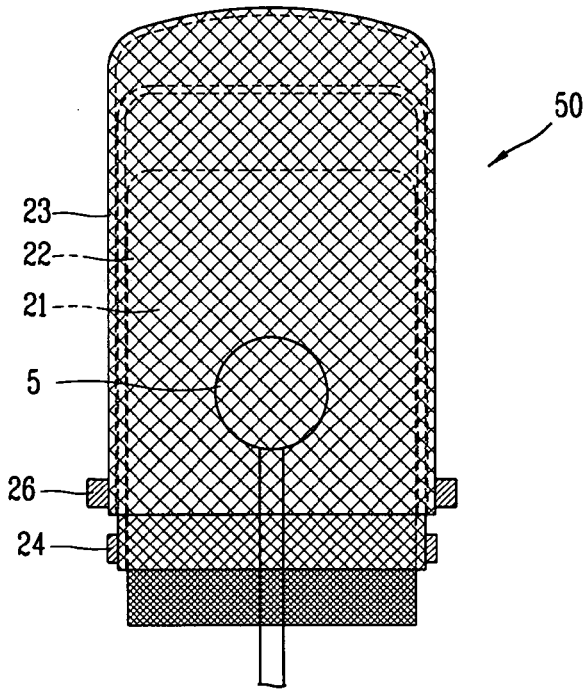
Figure 12:
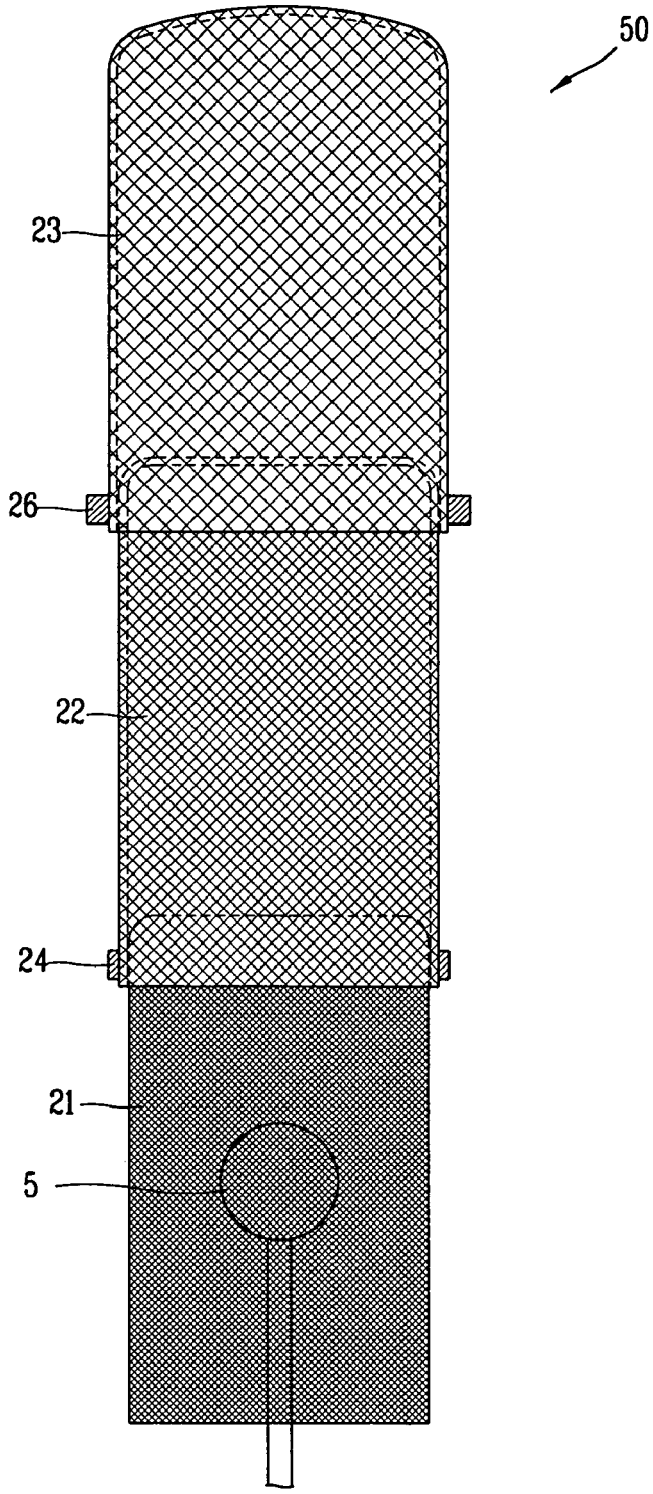

FIGS. 10 to 12 illustrate the third embodiment of the resonance unit applied to the electrodeless lighting apparatus of the present invention.

As illustrated therein, a resonance unit 50 in accordance with the third embodiment includes a first resonator 21 coupled with an outlet 4*a* of a waveguide 4 a second resonator 22 slidingly coupled with an outer circumferential surface of the first resonator 21 in its longitudinal direction and a third resonator 23 slidingly coupled with an outer circumferential surface of the second resonator 22 in the longitudinal direction.

Here, the perimeter of an inner circumferential surface of the third resonator 23 is greater than that of the outer circumferential surface of the second resonator 22, so that the outer circumferential surface of the second resonator 22 is slidingly inserted into the third resonator 23. Here, preferably, an interval between the outer circumferential surface of the second resonator 22 and an inner circumferential surface of the third resonator 23 is formed to have almost no margin by which the third resonator 23 can move in a radial direction of the second resonator 22.

The third resonator 23 has a cylindrical shape, and includes one end opened to be slidingly coupled with the outer circumferential surface of the second resonator 22 and the other end (opposite end) having a mesh structure.

In addition, one end of the second resonator 22 which is inserted into and coupled with the third resonator 23 is opened such that the bulb 5 is installed to be variably located inside the first, second and third resonators 21, 22 and 23.

Meanwhile, in order that the third resonator 23 is fixed to the second resonator 21, a second fixing member 26 is installed at the outer circumferential surface of the third resonator 23 overlapping the outer circumferential surface of the second resonator 22.

The second fixing member 26 has a ring shape having an opening formed to encompass the outer circumferential surface of the third resonator 23 such that the second fixing member 26 presses the outer circumferential surface of the second resonator 22 by an elastic restoring force. Like the first fixing member 24, the shape and structure is not limited to this, and any structure capable of fixing the third resonator 23 to the second resonator 22 is possible.

Here, preferably, the thickness of the first fixing member 24 pressing the outer circumferential surface of the second resonator 22 is designed within a range of margin between the second resonator 22 and the third resonator 23.

Meanwhile, the first, second and third resonators 21, 22 and 23 may have the same aperture ratio of the mesh or have different aperture ratios of the mesh. In addition, one of the first, second and third resonators 21, 22 and 23 may have a different aperture ratio from the other two.

That is, in case of the resonance unit comprising the first, second and third resonators 21, 22 and 23, there can be five portions, to the maximum, having different aperture ratios of the mesh including a portion where the first resonator 21 and the second resonator 22 overlap each other and a portion where the second resonator 22 and the third resonator 23 overlap each other.

Here, preferably, the bulb 5 is disposed at a portion having the lowest aperture ratio of the mesh among the portions having the different aperture ratios of the mesh which are formed as the height according to a longitudinal direction of the second resonator 22 and the third resonator 21 is varied in order to improve initial lighting and increase luminous intensity. However, according to a design, the bulb 5 can be disposed at another portion.

Meanwhile, an electrodeless lighting apparatus to which the resonance unit in accordance with the present invention is applied is not limited to the electrodeless light apparatus having the above-described construction, and can be effectively applied to an electrodeless lighting apparatus allowing lateral lighting.

The electrodeless lighting apparatus of the present invention is operated as follows.

Microwave generated from the microwave generator 2 is radiated into the resonance unit 20 or 50 in which the above-described resonators are slidingly coupled with each other in the longitudinal direction through the waveguide 4. The microwave excites buffer gas enclosed in the bulb 5 to generate light having a specific spectrum as a radiation material continuously becomes plasma. This light is reflected forward by the reflector 7 and the dielectric mirror 8.

Here, when the surrounding environment is changed, for example, changing the bulb 5 into one having a different color or different intensity of radiation, the height of the plurality of resonators 21, 23 and 24 are adjusted to thereby respond to the change. That is, the positions of the second resonator 22 and, in some cases, the third resonator 23 are varied along a direction in which the overall length of the resonance unit 20 or 50 gets greater. Then, by using the fixing members 24 and 26 installed at the outer circumferential surfaces, the second resonator 22 or the third resonator 23 is fixed at desired positions. Accordingly, the overall length of the resonance unit 20 or 50 gets greater and the volume inside also changes. The aperture ratio of the mesh changes according to the height of the resonance unit 20 or 50. As a result, since microwave is supplied to the resonance unit 20 or 50 having appropriate spatial distribution and aperture ratios of the mesh according to the height, the microwave can be applied onto a material enclosed in the bulb 5 under a resonance frequency and an electric field of the resonance unit 20 or 50. Accordingly, the maximum light efficiency can be obtained with ease without using a resonator newly and separately manufactured according to desired conditions.

As so far described, in the electrodeless lighting apparatus of the present invention, a resonator does not need to be separately manufactured according to the length or aperture ratios because the overall length of the resonance unit 20 can be varied or aperture ratios of the mesh according to the height of the resonance unit can be adjusted according to a bulb type or conditions to which the electrodeless lighting apparatus is applied by providing the resonance unit comprising at least two resonators having mesh structures which are slidingly coupled with each other in the longitudinal direction such that the overall length can be varied and the aperture ratios according to the height can be varied. Accordingly, time and costs spent manufacturing a new resonator can be reduced to thereby lower the unit cost and maintenance costs can be reduced by decreasing the number of assembly processes when changing a bulb.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless lighting apparatus comprising:

a waveguide for guiding microwave energy generated from a microwave generator;

a resonance unit coupled with an outlet of the waveguide and comprising at least two resonators having mesh structures which are slidingly coupled with each other in the longitudinal direction such that the height of the resonance unit is varied and an aperture ratio according to the height of the resonance unit is varied, the resonance unit for resonating the microwave energy guided through the waveguide; and a bulb located inside the resonance unit and generating light as a material enclosed therein becomes plasma by microwave energy.

2. The apparatus of claim 1, wherein the resonance unit comprises:

a first resonator coupled with the outlet of the waveguide; and a second resonator slidingly coupled with an outer circumferential surface of the first resonator in the longitudinal direction.

3. The apparatus of claim 2, wherein the first resonator has a cylindrical shape, and includes one end portion coupled with the outlet of the waveguide and the other end portion being opened.

4. The apparatus of claim 2, wherein the second resonator has a cylindrical shape and includes opened one end portion slidingly coupled with the outer circumferential surface of the first resonator and the other end portion having a mesh structure.

5. The apparatus of claim 2, wherein a fixing member is installed at an outer circumferential surface of the second resonator overlapping the outer circumferential surface of the first resonator such that the second resonator is fixed to the first resonator.

6. The apparatus of claim 5, wherein the fixing member is a ring having an opening formed to encompass the outer circumferential surface of the second resonator in order to press the outer circumferential surface of the second resonator by an elastic restoring force.

7. The apparatus of claim 2, wherein the resonance unit further comprises:

a third resonator slidingly coupled with the outer circumferential surface of the second resonator in its longitudinal direction.

8. The apparatus of claim 7, wherein the third resonator has a cylindrical shape, and includes opened one end portion slidingly coupled with the outer circumferential surface of the second resonator and the other portion having a mesh structure.

9. The apparatus of claim 8, wherein a fixing member is installed at an outer circumferential surface of the third resonator overlapping the outer circumferential surface of the second resonator such that the third resonator is fixed to the second resonator.

10. The apparatus of claim 9, wherein the fixing member has an opening formed to encompass the outer circumferential surface of the second resonator in order to press the outer circumferential surface of the second resonator by an elastic restoring force.

11. The apparatus of claim 1, wherein said resonators have the same aperture ratio.

12. The apparatus of claim 1, wherein said resonators have different aperture ratios from each other.

13. The apparatus of claim 1, wherein the bulb is provided inside the resonance unit in order to be located at a region having the lowest aperture ratio in a longitudinal direction of the resonance unit.

* * * * *